US009638476B2

(12) United States Patent
Kerler et al.

(10) Patent No.: US 9,638,476 B2
(45) Date of Patent: May 2, 2017

(54) PLATE-SHAPED HEAT EXCHANGER FOR A COOLING DEVICE COMPRISING AT LEAST ONE HEART EXCHANGER PACKAGE

(75) Inventors: Boris Kerler, Stuttgart (DE); Steffen Grözinger, Vaihingen (DE); Mehmet Tosun, Stuttgart (DE); Christian Schnepf, Stuttgart (DE); Florian Schmidt, Kornwestheim (DE); Hans-Joachim Krauss, Stuttgart (DE); Vinko Lukcin, Stuttgart (DE); Stéphanie Larpent, Stuttgart (DE)

(73) Assignee: MAHLE INTERNATIONAL GMBH, Stuttgart (DE)

( * ) Notice: Subject to any disclaimer, the term of this patent is extended or adjusted under 35 U.S.C. 154(b) by 1095 days.

(21) Appl. No.: 13/814,041

(22) PCT Filed: Aug. 4, 2011

(86) PCT No.: PCT/EP2011/063469
§ 371 (c)(1),
(2), (4) Date: Jun. 11, 2013

(87) PCT Pub. No.: WO2012/017044
PCT Pub. Date: Feb. 9, 2012

(65) Prior Publication Data

US 2013/0264038 A1 Oct. 10, 2013

(30) Foreign Application Priority Data

Aug. 5, 2010 (DE) ..... 10 2010 038 945

(51) Int. Cl.
*F28F 3/08* (2006.01)
*F28F 1/32* (2006.01)
(Continued)

(52) U.S. Cl.
CPC ..... *F28F 3/08* (2013.01); *F28F 1/325* (2013.01); *F28D 1/053* (2013.01);
(Continued)

(58) Field of Classification Search
CPC ..... F28F 3/08; F28F 3/04; F28F 3/046; F28F 1/325; F28F 2225/06; F28D 1/053; F28D 2021/0082
(Continued)

(56) References Cited

U.S. PATENT DOCUMENTS 2,063,736 A * 12/1936 Hardiman ..... F28D 1/024 165/165
3,266,567 A * 8/1966 Kinal ..... F28F 1/32 165/151
(Continued)

FOREIGN PATENT DOCUMENTS

CH 237 258 A 4/1945
DE 73 07 618 U 2/1973
(Continued)

OTHER PUBLICATIONS

International Search Report, PCT/EP2011/063469, Feb. 13, 2012, 3 pgs.
German Search Report, DE 10 2010 038 945.5, Feb. 1, 2011, 4 pgs.

*Primary Examiner* — Tho V Duong
(74) *Attorney, Agent, or Firm* — Paul D. Strain, Esq.; Strain & Strain PLLC

(57) ABSTRACT

The invention relates to a plate-shaped heat exchanger for a cooling device comprising at least one heat exchanger package, in particular for a motor vehicle, consisting of a plurality of openings for accommodating a pipe conducting a coolant, wherein each opening is surrounded by an passage and a plurality of projections are distributed between the passages for the heat exchange with the medium to be cooled. In order to allow a high performance increase of a
(Continued)

cooling device, yet a low increase in pressure loss of the charge air, a plurality of projections are arranged around an passage, wherein the projections have a shape that assures deliberate heat conduction from the projections to the passage.

7 Claims, 10 Drawing Sheets

(51) Int. Cl.
*F28D 1/053* (2006.01)
*F28D 21/00* (2006.01)

(52) U.S. Cl.
CPC .. *F28D 2021/0082* (2013.01); *F28F 2215/08* (2013.01); *F28F 2225/06* (2013.01)

(58) Field of Classification Search
USPC ..... 165/151
See application file for complete search history.

(56) References Cited

U.S. PATENT DOCUMENTS 3,916,989 A * 11/1975 Harada ..... F28F 1/325 165/151
4,550,776 A * 11/1985 Lu ..... F28F 1/325 165/151
4,923,002 A * 5/1990 Haussmann ..... F28F 1/32 165/151
5,794,690 A 8/1998 Kim et al.
5,927,392 A * 7/1999 Youn ..... F28F 1/325 165/151
5,975,199 A * 11/1999 Park ..... F28F 1/325 165/151
6,125,925 A * 10/2000 Obosu ..... F28F 1/325 165/151
7,021,370 B2 * 4/2006 Papapanu ..... F28F 1/325 165/151

FOREIGN PATENT DOCUMENTS

| | | | |
|---|---|---|---|
| DE | 2 305 056 | A1 | 4/1974 |
| DE | 87 17 766 | U1 | 3/1990 |
| DE | 102 27 930 | A1 | 1/2004 |
| FR | 2 560 369 | A1 | 8/1985 |
| GB | 2 125 529 | A | 3/1984 |
| JP | 60-26292 | A | 2/1985 |
| JP | 2001-147087 | A | 5/2001 |
| WO | WO 97/12191 | A1 | 4/1997 |

* cited by examiner

9b)

9a)

PLATE-SHAPED HEAT EXCHANGER FOR A COOLING DEVICE COMPRISING AT LEAST ONE HEART EXCHANGER PACKAGE

CROSS-REFERENCE TO RELATED PATENT APPLICATIONS

This application is a National Stage of International Application No. PCT/EP2011/063469, filed Aug. 4, 2011, which is based upon and claims the benefit of priority from prior German Patent Application No. 10 2010 038 945.5, filed Aug. 5, 2010, the entire contents of all of which are incorporated herein by reference in their entirety.

The invention relates to a plate-shaped heat exchanger for a cooling device comprising at least one heat exchanger package, in particular for a motor vehicle, consisting of a plurality of openings for accommodating a tube conducting a coolant, wherein each opening is surrounded by a rim hole and a plurality of projections are distributed between the rim holes for heat exchange with the medium to be cooled.

Figure 1:
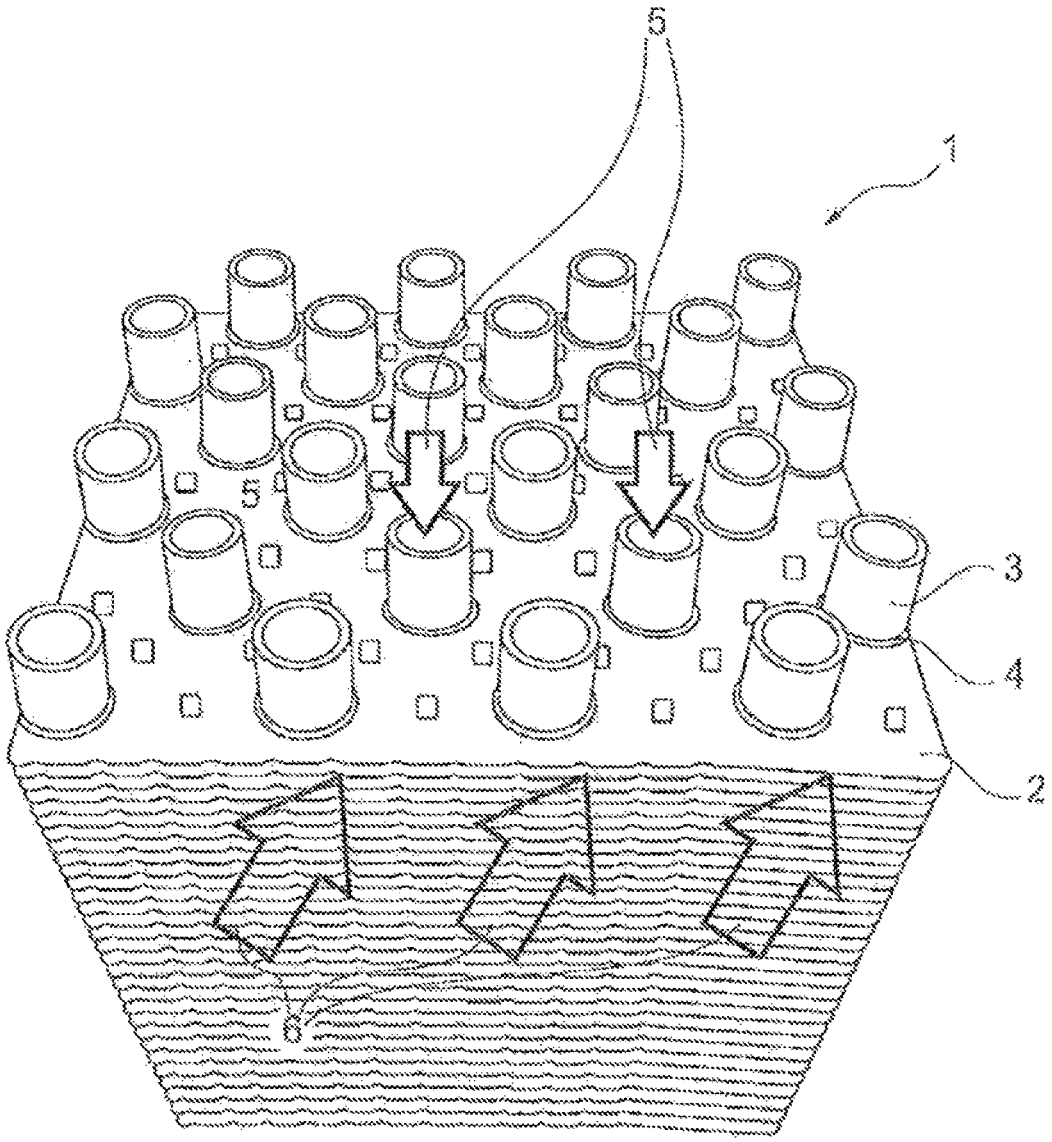

Charge-air coolers of round tube construction are known which are represented in FIG. 1. Here, such a charge-air cooler consists of a package of plate-shaped heat exchangers 2 which are also designated as corrugated ribs. Each plate-shaped heat exchanger 2 here has a plurality of openings 7 into each of which a round tube 3 is fitted and is connected to the plate-shaped heat exchanger 2 via a mechanical widening of the rim holes 4 surrounding the opening. A coolant 5 flows through the round tubes 3 while the charge air 6 to be cooled, which comes from a combustion engine (not shown further), flows perpendicularly to the round tubes 3 into the heat exchanger package consisting of many plate-shaped heat exchangers 2, this taking place perpendicularly to the round tubes 3.

Figure 2:
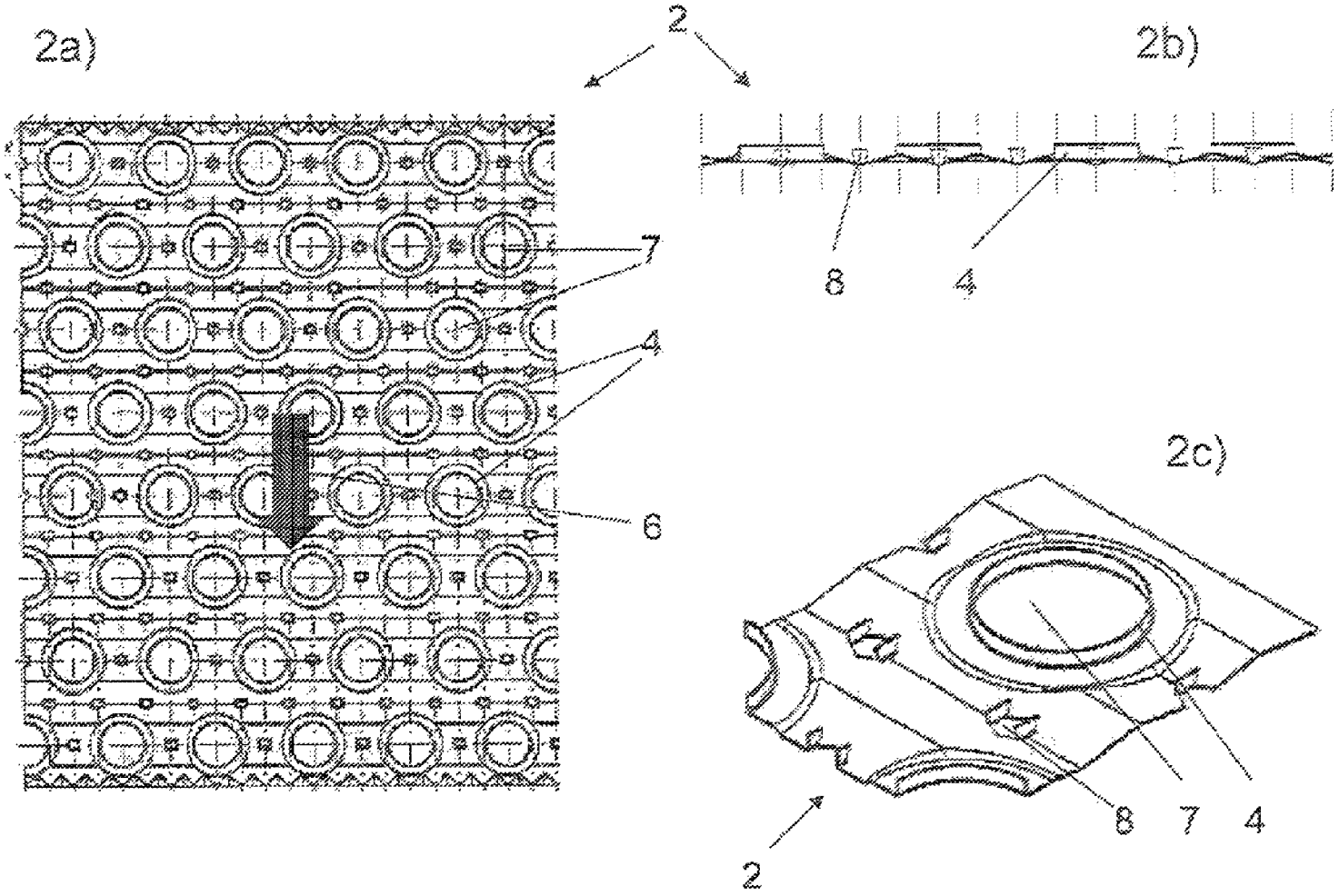

A single plate-shaped heat exchanger 2 is illustrated in FIG. 2, with the rim holes 4 enclosing the openings 7 being arranged in a plurality of rows (FIG. 2*a*). FIG. 2*b* shows a cross section through the plate-shaped heat exchanger 2 while FIG. 2*c* illustrates a perspective representation of a rim hole 4. The rim holes 4 here ensure the contact with the round tubes 3 which discharge the heat from the charge-air cooler 1 via the coolant 5. Arranged between the rim holes 4 are turbulators or spacers 8 which are distributed symmetrically between the rim holes 4 enclosing the openings 7. The turbulators or spacers 8 receive the plate-shaped heat exchanger 2 arranged above them, wherein there is sufficient spacing between the two plate-shaped heat exchangers 2 to ensure that the charge air 6 coming from the combustion engine can flow between these heat exchangers 2. The turbulators or spacers 8 can additionally cause the laminar flow of the charge air 6 to be converted into a turbulent flow so that the heat transfer over the entire plate-shaped heat exchanger 2 can be better ensured.

Figure 3:
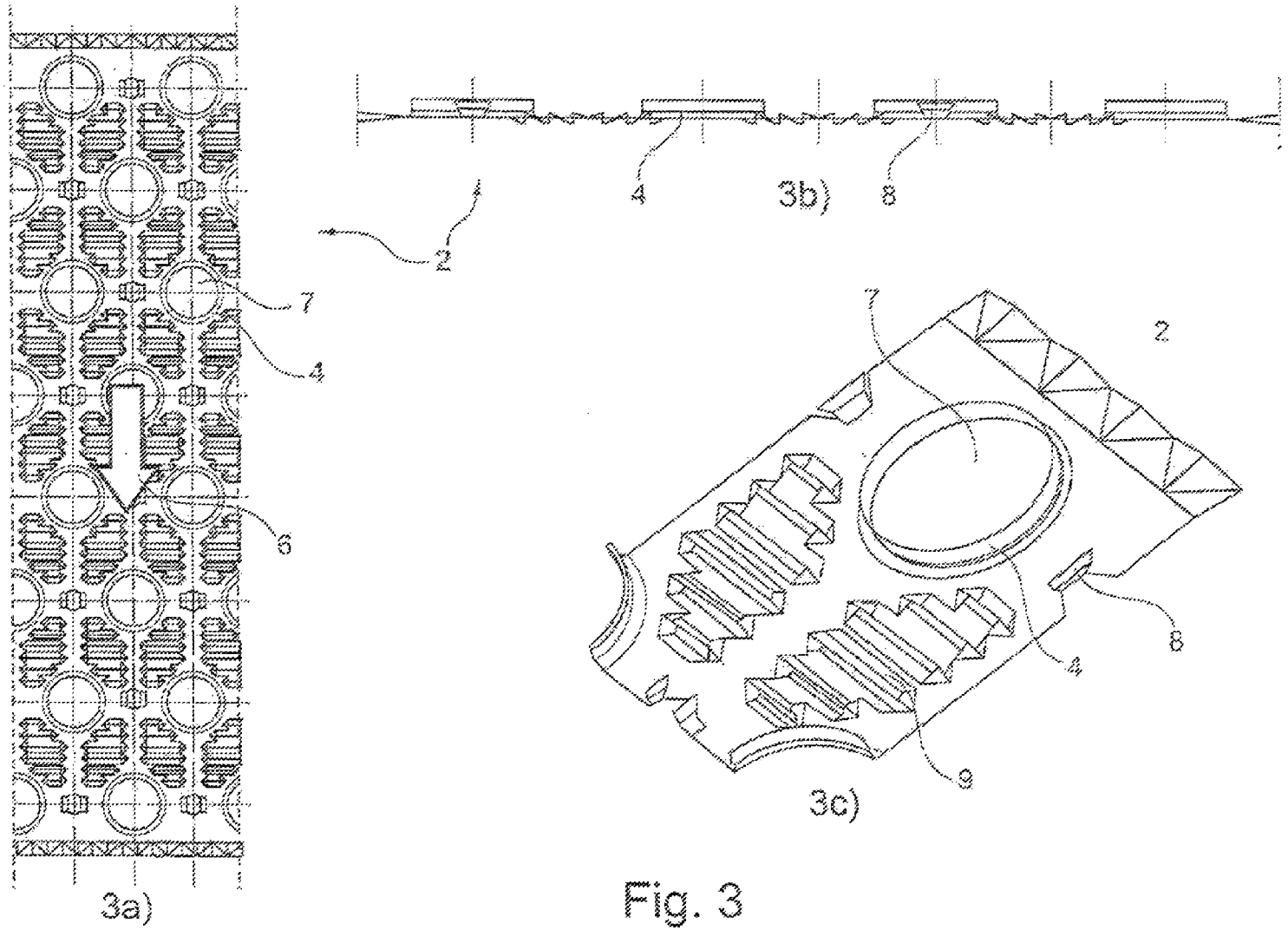

FIG. 3 illustrates a further known design of a plate-shaped heat exchanger 2 in which a gill area 9 is arranged between the rim holes 4. This gill area 9 has the task of causing turbulences in the air flow of the charge air 6 and of ensuring an improved transverse exchange of the charge air 6 between the individual plate-shaped heat exchangers 2 situated above one another. In addition to the gill area 9 there are turbulators or spacers 8 which serve as a support for the next plate-shaped heat exchanger 2.

Figure 4:
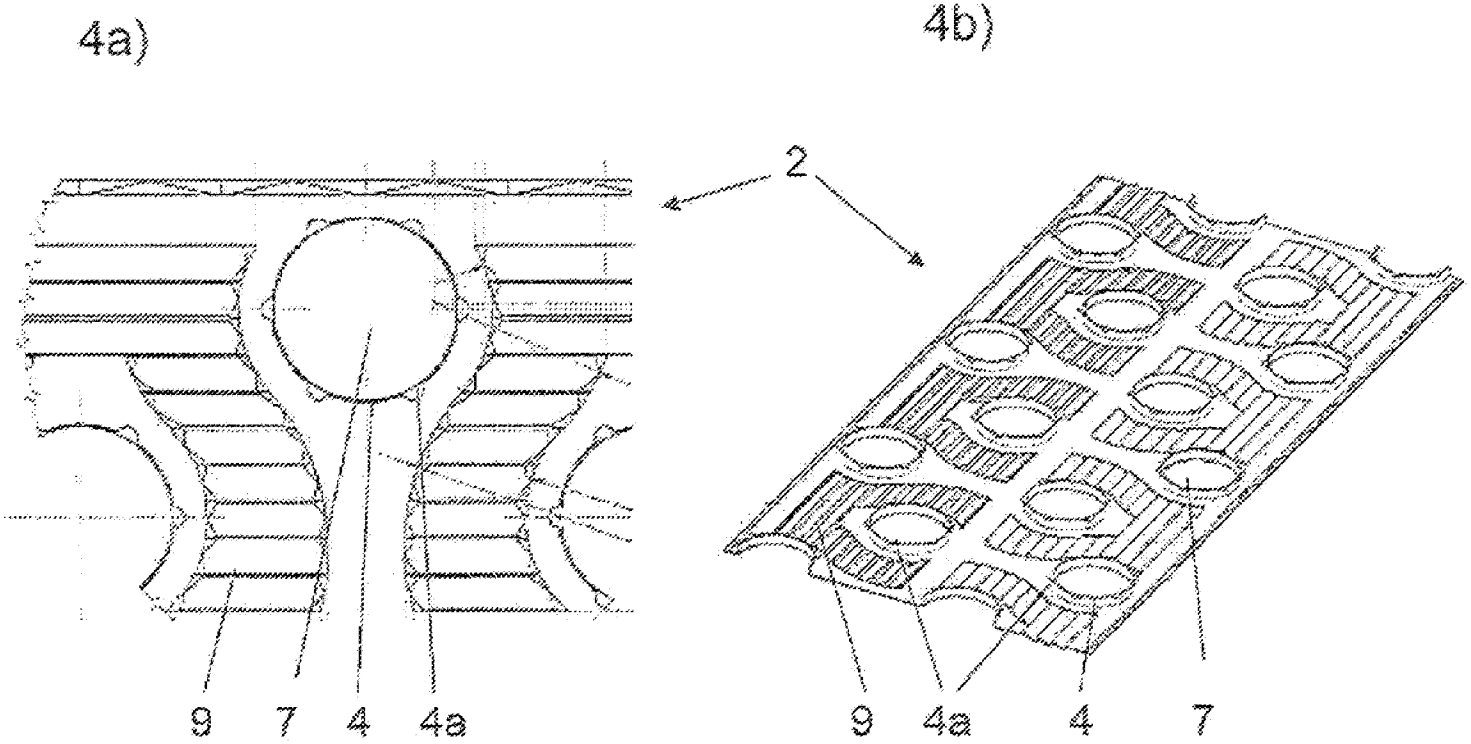

In a known refinement according to FIG. 4, the rim hole 4 has what are known as crown tulips 4*a* which are arranged on the rim hole 4 with a spacing around its circumference. These crown tulips 4*a* serve as spacers for the plate-shaped heat exchanger 2 situated thereon, thereby making it possible to dispense with separate spacers 8. Here, too, each rim hole 4 and the opening 7 surrounded by the rim hole 4 are surrounded by a gill area 9.

Owing to the often inhomogeneous flow of the charge air 6 against the charge-air cooler 1 with high charge-air mass flows, the plate-shaped heat exchangers 2 must in operation have a high mechanical stability to vibrations and oscillations to avoid breakages of the heat exchangers 2. It is therefore an object of the invention to provide a plate-shaped heat exchanger which allows a high heat transfer from the charge air to the coolant, while the pressure drop of the charge air is to be kept as low as possible.

According to the invention, the object is achieved in that a plurality of projections are arranged around a rim hole, wherein the projections have a shape which ensures a targeted heat conduction from the projections to the rim hole. As a result of such a shape of the projection, it is ensured that although the required turbulences for the heat exchange are generated by the projections on the plate-shaped heat exchanger and the turbulent air mass is fed to the rim hole, only a small pressure drop increase of the charge air occurs.

Advantageously, the projections are arranged approximately circularly around the rim hole. Such a circular arrangement ensures that the turbulent air which is produced by the projections is fed directly to the rim hole and thus, given an installation in a cooling device, to the round tube surrounded by the rim hole. Consequently, the heat exchange of the cooling device is improved.

In one refinement, the projection is of circular segment-like design. As a result of this circular segment-like shape of the projection, the new incoming flow of the charge air to generate turbulences is assisted and a transverse exchange between the various plate-like heat exchangers is ensured.

In a variant, the width and/or the length and/or the height of the circular segment-like projection and/or the spacing between two adjacent circular segment-like projections and/or the spacing of the circular segment-like projection to a rim hole depends on the heat conduction to be achieved from the circular segment-like projection to the rim hole. Consequently, the configuration of the plate-shaped heat exchanger can always be concretely adapted to the desired performance requirements of the cooling device.

In a development, the circular segment-like projections are arranged in two or more rows around the rim hole. Hence, the air flow in the direction of the rim hole is increased, and there is also an improvement in the heat conduction.

Advantageously, the projections are arranged in a ray-like manner around the rim hole. This has the advantage that new incoming flows of the charge air form very well to generate turbulences, while at the same time a short direct path for heat conduction to the rim holes and thus to the round tubes of the cooling device is present.

In one refinement, the ends of the ray-like projections that point in the direction of the rim hole are arranged approximately circularly around the rim hole, wherein there extends along the longitudinal extent of at least one ray-like projection a first material overhang which enables air exchange in the direction of the rim hole and in particular the width of the ray-like projection and/or the height of the ray-like projection and/or the depth of the ray-like projection depends on the heat conduction to be achieved from the ray-like projection to the rim hole. As a result of the material overhangs, the air flows are channeled, and the transverse exchange between the plate-shaped heat exchangers situated above one another is improved. This transverse exchange results in a more homogeneous impingement flow by the charge air. Owing to the design of the material overhangs, the targeted heat conduction to the rim hole is achieved in a structurally simple manner.

In a development, the ray-like projections are subdivided into at least two groups which are arranged around the rim hole in such a way that each group is positioned at a spacing from a line which runs approximately centrally through the rim hole and extends perpendicularly to an edge of the heat exchanger. Since the heat exchanger is designed as a strip-shaped sheet-metal stamping, it is necessary to individually separate it into the desired size of the individual plate-shaped heat exchangers. To ensure that the structure of the heat exchanger is not disturbed by the separating process, the invention advantageously provides the spacing between these groups.

In a further variant, the rim hole has, at a spacing from the surface of the heat exchanger, a second material overhang for receiving a heat exchanger situated above it. Thus, the rim hole itself serves as spacer for the heat exchanger situated above. It is therefore possible to dispense with additional spacers. As a result, the production process of the heat exchanger is simplified.

Advantageously, to increase the strength of the edge region of the heat exchanger, the edge region has a corrugation and/or at least one bead and/or at least one turbulator and/or at least one spacer is arranged in the edge region and/or the width of the edge region is reduced up to a first row of rim holes. By virtue of these measures, which can be carried out independently or in combination, the strength of the edge region of the plate-shaped heat exchanger is mechanically stabilized, with the result that cracks in this region are reliably avoided.

Figure 5:
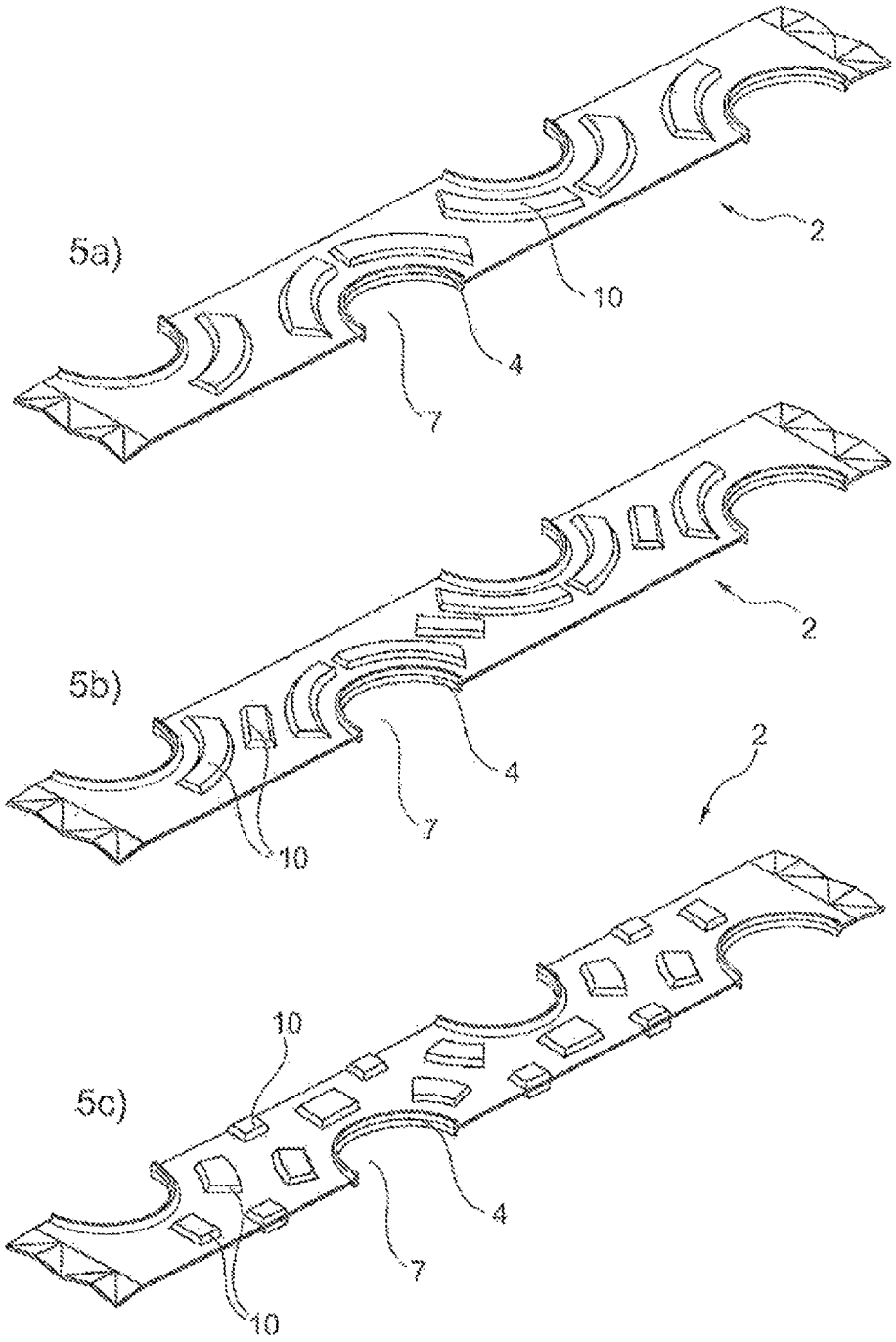
Figure 6:
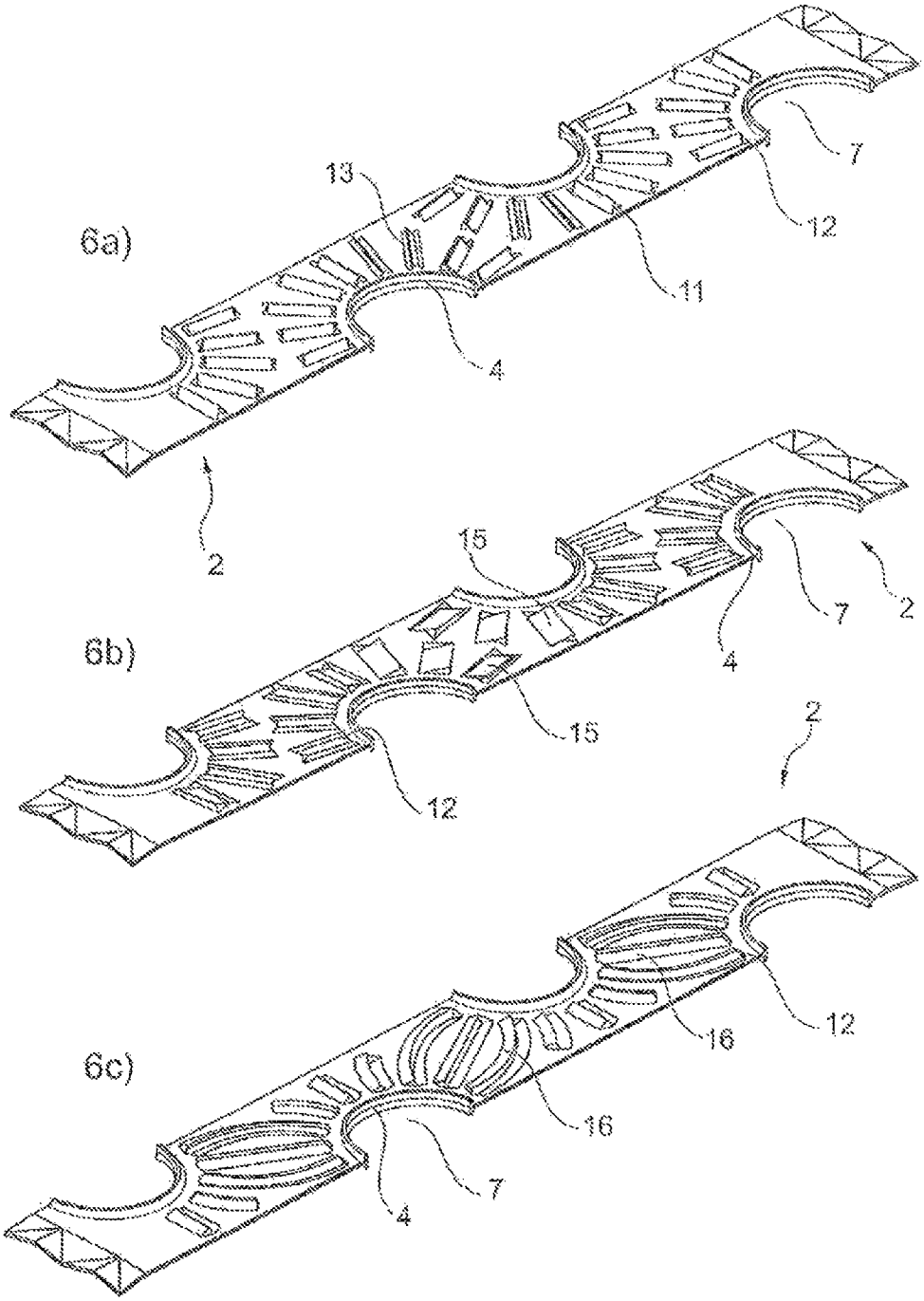
Figure 8:
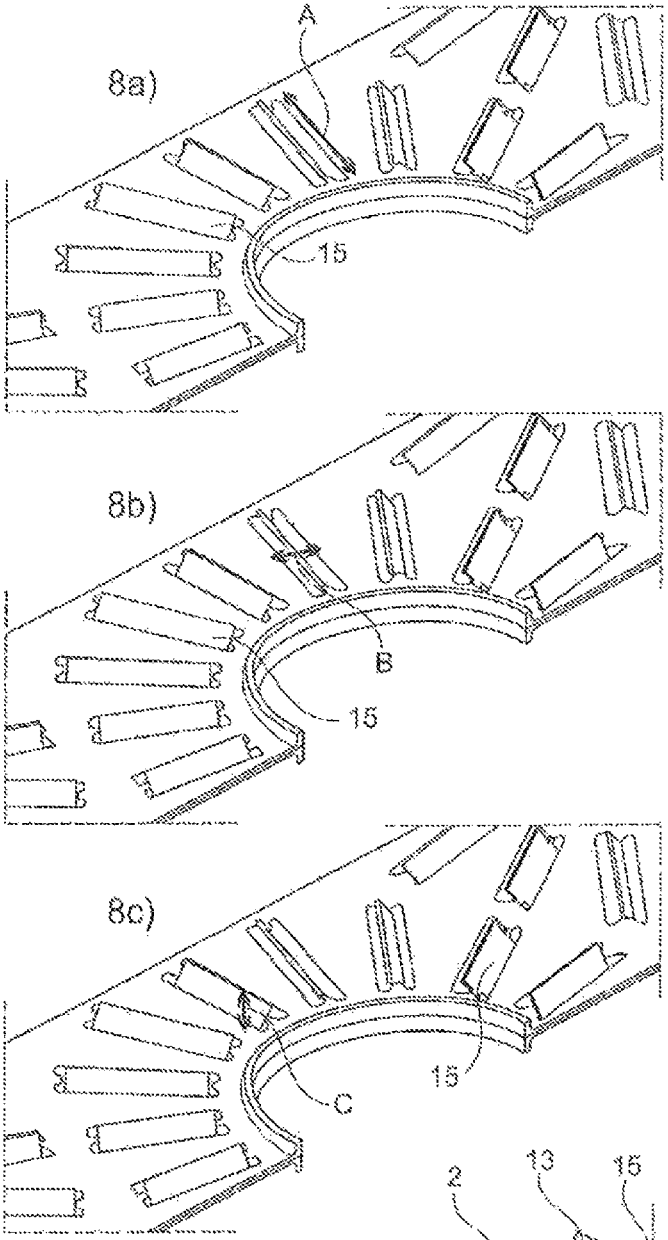
Figure 7:
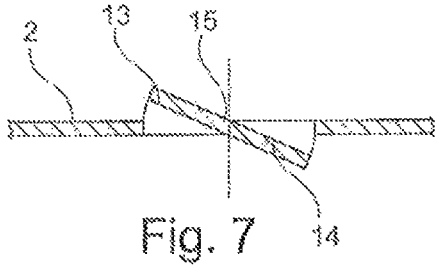
Figure 9:
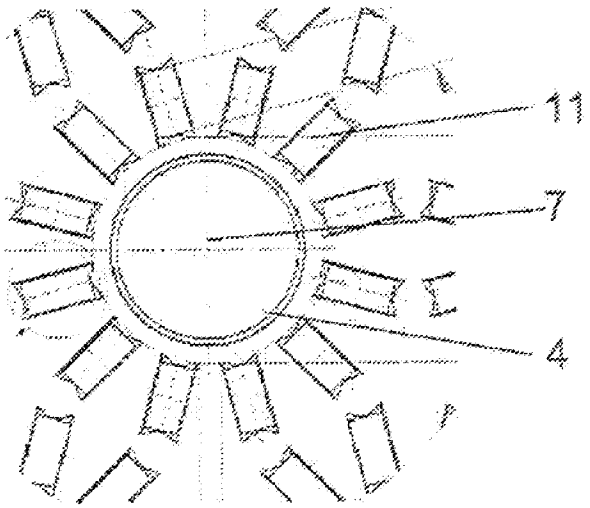
Figure 9:
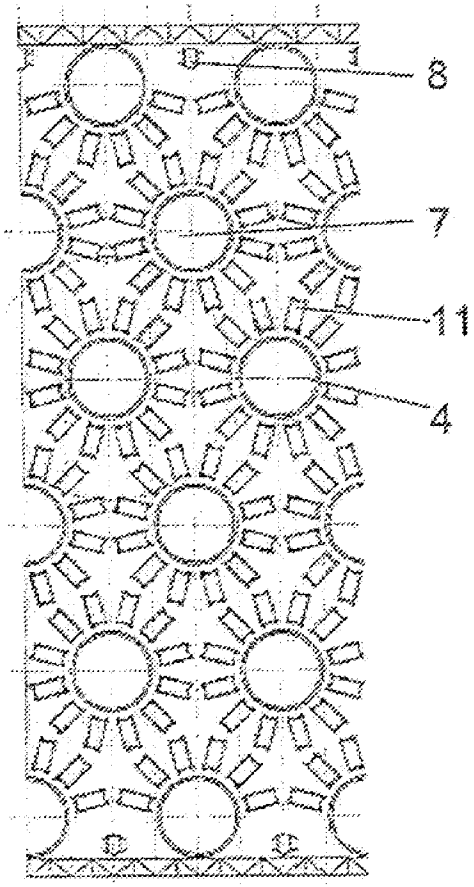
Figure 10:
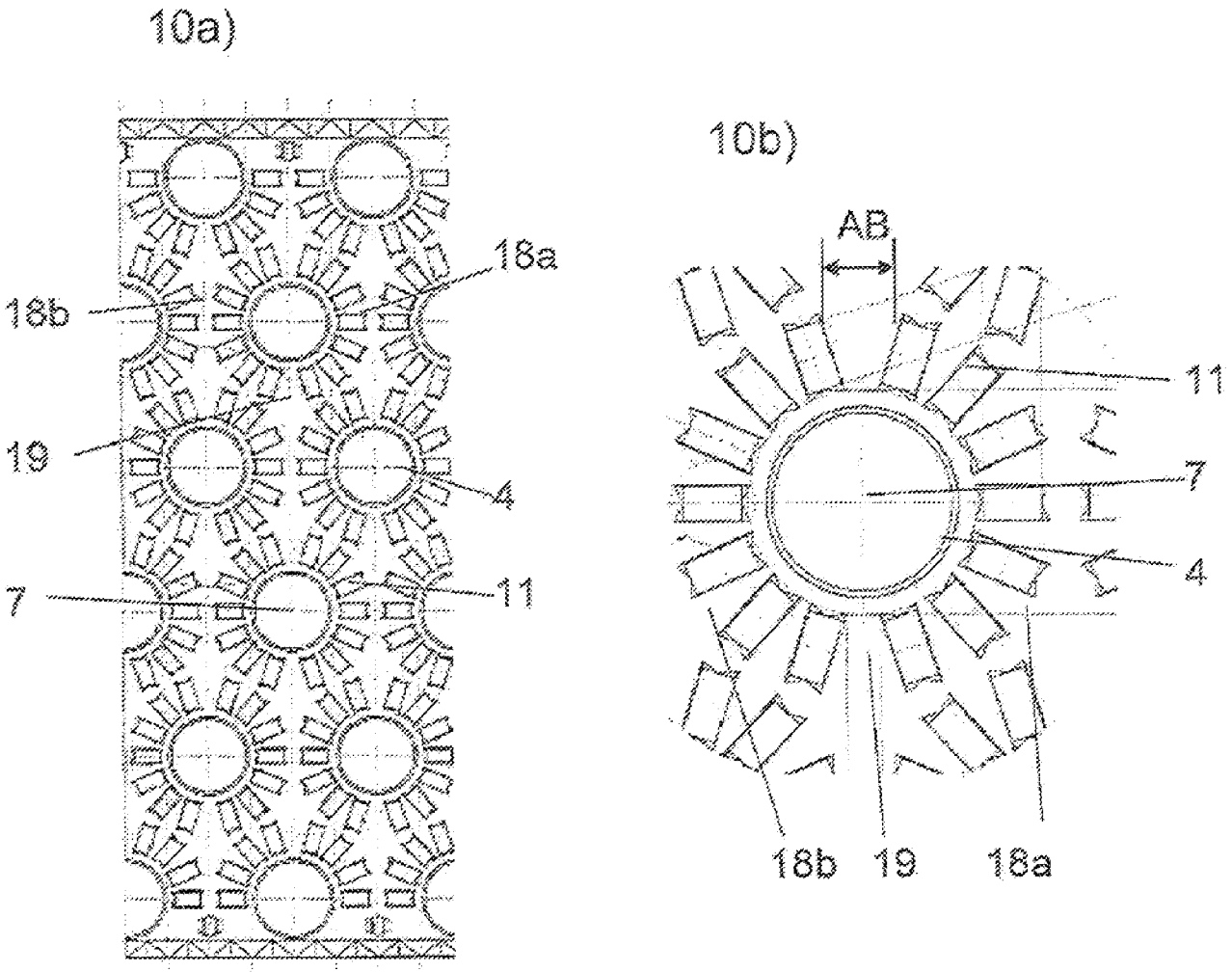
Figure 11:
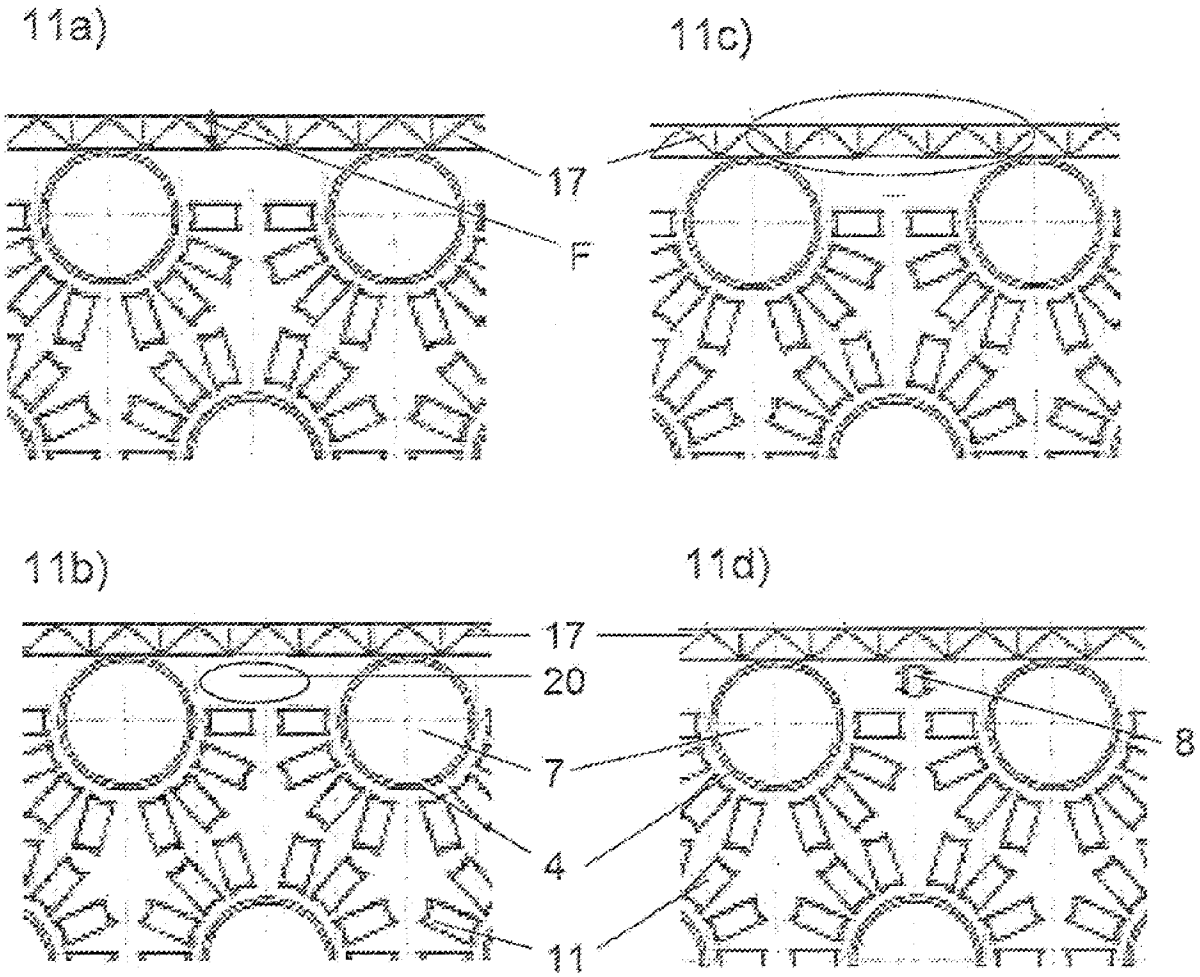

The invention permits numerous embodiments. Some of them will be explained in more detail with reference to the figures illustrated in the drawing, in which:

FIG. 1 shows a charge-air cooler according to the prior art,

FIG. 2 shows a first plate-shaped heat exchanger according to the prior art, FIG. 3 shows a second plate-shaped heat exchanger according to the prior art, FIG. 4 shows a third plate-shaped heat exchanger according to the prior art, FIG. 5 shows a plate-shaped heat exchanger with circular segment-like projections, FIG. 6 shows a plate-shaped heat exchanger with ray-like projections, FIG. 7 shows a cross section through a projection configured as a gill, FIG. 8 shows a plate-shaped heat exchanger with projections configured as gills, FIG. 9 shows a plan view of a plate-shaped heat exchanger with ray-like projections configured as gills, FIG. 10 shows a second plate-shaped heat exchanger with ray-like projections configured as gills, and FIG. 11 shows an edge region of the plate-shaped heat exchanger.

Identical features are denoted by identical reference signs.

FIG. 5 shows a detail of a plate-shaped heat exchanger 2 having circular segment-like projections 10 which enclose the opening 7. The circular segment-like projections 10 here form a circle around the opening 7. As can be seen from the various FIGS. 5*a*, 5*b* and 5*c*, the dimensions of the circular segment-like projections 10 here can be chosen to be very different. FIG. 5*a* discloses circular segment-like projections 10, where each circular segment-like projection 10 covers approximately an angle of 90°. FIG. 5*c* here shows circular segment-like projections which are substantially shorter than the circular segment-like projections according to FIGS. 5*a* and 5*b*. As illustrated in FIG. 5*b*, the circular segment-like projections 10 can also be arranged in multiple rows around the opening 7. Each circular segment-like projection 10 here represents a stamped-out portion which is arranged around the opening 7, wherein each opening 7 is surrounded by a circular rim hole 4.

By virtue of the charge air 6 which originates from a combustion engine and is conducted through the plate-shaped heat exchangers 2 which are stacked above one another and form a package, the heat contained in the charge air 6 is passed to the circular segment-like projections 10. The circular segment-like projections 10 here serve not only as heat exchangers but also simultaneously as turbulence generators, the laminar air flow of the charge air 6 being converted into a turbulent air flow. This conversion has the advantage that a good heat supply to all circular segment-like projections 10 takes place. As a result of the circular arrangement of the circular segment-like projections 10 around the rim hole 4 and thus the opening 7, a new incoming flow of the charge air 6 takes place to generate the turbulences at each circular segment-like projection 10, thereby improving the heat exchange from the circular segment-like projection 10 to the opening 7. The shape of the circular segment-like projections 10 produces an increase in their area, which is accompanied by an increased heat absorption from the charge air 6. Since the circular segment-like projections 10 also have openings (not shown further), for example in the form of slots, a transverse exchange of the charge air 6 between the different plate-shaped heat exchangers 2 which are arranged above one another is ensured. Consequently, in spite of an inhomogeneous flow against the plate-shaped heat exchangers in the cooling device, an improved heat exchange is achieved between charge air and coolant which flows through round tubes (not shown further) which are inserted into the openings 7.

Instead of the circular segment-like projections 10, other stamped-out portions, for example in the form of ellipses, are also possible around the rim holes 4.

FIG. 6 illustrates a plate-shaped heat exchanger 2 which has ray-like projections 11. As can be seen from FIGS. 6*a* to 6*c*, these ray-like projections 11 are also arranged circularly around the rim hole 4 and thus around the opening 7. The ray-like projections 11 have an elongate design, with the narrow ends 12 of the ray-like projection 11 being arranged opposite the rim hole 4 and being guided directly up to the rim hole 4. The ray-like projections 11 here have slots in their longitudinal direction, with material overhangs 13 protruding out of the ray-like projections 11. In FIG. 5*b*, the ray-like projections are formed as so-called gills 15. The number of the projections 11 in FIG. 5*a* and of the gills 15 in FIG. 5*b* is in this case different depending on the size of the ray-like projections 11 or the gills 15.

In FIG. 6*c*, the ray-like projections 16 are not, as in FIG. 6*a*, formed rectilinearly, but have a slight curvature. The ray-like projections 11, 15 or 16 serve as heat exchangers in that they absorb the heat supplied from the charge air 6 and transport it in the direction of the rim hole 4, the round tube (not shown further) flowing with the coolant through the rim hole 4. These projections 11, 15 and 16 arranged in a ray-like manner here have the particular advantage that the heat conduction is directed directly to the opening 7 and thus to the round tube, with no interruptions in the heat conduction being present as a result of structural components situated in between.

FIG. 7 illustrates a cross section through a gill 15 as is worked out from the plate-shaped heat exchanger 2. Here, the gill 15 protrudes with its first material overhang 13 above the upper side of the plate-shaped heat exchanger 2, whereas the second material overhang 14 of the gill 15 is directed in the direction below the plate-shaped heat exchanger 2. Owing to this simple design, a very good transverse exchange of the charge air between the different plate-shaped heat exchangers 2 is possible.

As can be seen from FIG. 8, these ray-like projections in the form of gills 15 can vary in a structurally simple manner in their design. This concerns the width (arrow A in FIG. 8*a*) and equally the depth (arrow B in FIG. 8*b*) and also the height, which is identified by the arrow C in FIG. 8*c*. As a result of these variations, the flow conditions at the ray-like projections 11, 15 and 16 improve, thereby leading to a better heat conduction and thus to an improved performance capability of the cooling device. The angle of the gills 15 also contributes to better heat transfer. The heat conduction here is ensured all the better the larger the number of the projections 11, 16 or gills 15 for each rim hole 4.

FIG. 9*a* illustrates a detail of a plan view of a plate-shaped heat exchanger 2 which has openings 7 arranged in rows, wherein each opening 7 is surrounded by a rim hole 4. Whereas the centrally arranged rim holes 4 are completely surrounded by ray-like projections 11, the rim holes 4 in the edge region 17 are only approximately half-surrounded by the ray-like projections 11. Spacers 8 are situated in the edge region 17 between the rim holes 4 on the side opposite to the ray-like projections 11. These spacers 8 have the task of stabilizing the edge region 17 against mechanical stresses. FIG. 9*b* once again illustrates a detail around an opening 7 with a rim hole 4 which are surrounded by the ray-like projections 11. Here, the ray-like projections 11 are all arranged with the same spacing in a circle around the opening 7.

FIG. 10 shows a second illustration of a plate-shaped heat exchanger 2 in which, as can be seen from FIG. 10*b*, the ray-like projections 11 are subdivided into two groups 18*a*, 18*b*. In each group 18*a*, 18*b*, the ray-like projections 11 here have an identical spacing from one another, wherein the spacing AB of the two groups 18*a*, 18*b* from one another is greater than the spacing of the ray-like projections 11 within a group 18*a*, 18*b*. As can be seen from FIG. 10*a*, a gap 19 thus extends between the groups 18*a*, 18*b* and is used to cut to size the plate-shaped heat exchangers 2 from a strip, the structure of the plate-shaped heat exchangers 2 remaining uninfluenced during the cutting-to-size process.

In the case of the variants explained in connection with FIGS. 9 and 10, a performance increase of the heat transfer of approximately 10% is ensured with a pressure drop increase of approximately <50% of the charge air 6. Consequently, the growing performance requirements in cooling devices are ensured.

FIGS. 11*a* to 11*d* illustrate different measures for increasing the strength of the edge region 17 of the plate-shaped heat exchangers 2. Owing to the heat supplied with the charge air 6, vibrations result in the edge region of the plate-shaped heat exchangers 2, these vibrations possibly leading to cracks and consequently to instabilities of the edge region 17. Such instabilities can be prevented if, as illustrated in FIG. 11*a*, the edge region is reduced up to the first row of the rim holes 4 (arrow F).

A second measure for improving the stability of the edge region 17 comprises incorporating a bead 20 close to the edge region 17 between two adjacent rim holes 4 (FIG. 11*b*).

Another improvement in the stability of the edge region 17 is achieved if the entire edge region 17 has a corrugation, thereby ensuring a stability against cracks, this being illustrated in FIG. 11*c*.

A turbulator or a spacer 8 which is arranged between two adjacent rim holes 4 (as illustrated in FIG. 11*d*) also contributes to improving the strength of the edge region 17.

For all the variants explained, it holds that the material used for the plate-shaped heat exchangers 2 is aluminum, stainless steel, copper or the like. The density of the plate-shaped heat exchangers 2 described in a package can here be made variable, and equally the longitudinally and transversely dividing arrangement of the rim holes 4 of the plate-shaped heat exchangers 2 is variable. A use of the plate-shaped heat exchangers 2 described is in this case not only possible in a charge-air cooler, but is also conceivable in exhaust-gas coolers, in evaporators or radiators.

By means of the device described, a high performance increase in the heat exchange of the cooling device is possible. Here, a reduced pressure drop increase of the charge air is ensured and a mechanical stability of the edge region against vibrations is provided.

The invention claimed is:

1. A plate-shaped heat exchanger for a cooling device comprising at least one heat exchanger package, wherein the heat exchanger package comprises a plurality of openings for accommodating a tube conducting a coolant, wherein each opening is surrounded by a rim hole and a plurality of projections are distributed between the rim holes for heat exchange with the medium to be cooled, wherein a plurality of projections are arranged around a rim hole, wherein the projections have a shape which ensures a targeted heat conduction from the projection to the rim hole, wherein the ends of the projections are arranged approximately circularly around the rim hole and extend orthogonally away from the rim hole, wherein a turbulator or spacer is arranged between adjacent rim holes, wherein the turbulator or spacer supports a heat exchanger package situated above, wherein a bead is arranged between adjacent rim holes in an edge region of the plate-shaped heat exchanger, wherein the edge region comprises a corrugation.

2. The heat exchanger as claimed in claim 1, wherein the projection is of circular segment-like design.

3. The heat exchanger as claimed in claim 2, wherein the width and/or the length and/or the height of the circular segment-like projection and/or the spacing between two adjacent circular segment-like projections and/or the spacing of the circular segment-like projection to a rim hole depends on the heat conduction to be achieved from the circular segment-like projection to the rim hole.

4. The heat exchanger as claimed in claim 2, wherein the circular segment-like projections are arranged in two or more rows around the rim hole.

5. The heat exchanger as claimed in claim 1, wherein there extends along the longitudinal extent of at least one projection a first material overhang which enables air exchange in the direction of the rim hole and in particular the width of the projection and/or the height of the projection and/or the depth of the projection depends on the heat conduction to be achieved from the projection to the rim hole.

6. The heat exchanger as claimed in claim 1, wherein the projections are subdivided into at least two groups which are arranged around the rim hole in such a way that each group is positioned at a spacing from a line which runs approximately centrally through the rim hole and extends perpendicularly to an edge of the heat exchanger.

7. The heat exchanger as claimed in claim 1, wherein the rim hole has, at a spacing from the surface of the heat exchanger, a crown tulip for receiving a heat exchanger situated above it.

* * * * *